US011173716B2

(12) United States Patent
Arnold et al.

(10) Patent No.: US 11,173,716 B2
(45) Date of Patent: Nov. 16, 2021

(54) LEAK MITIGATION DEVICES

(71) Applicant: Hewlett-Packard Development Company, L.P., Spring, TX (US)

(72) Inventors: Chris Arnold, Vancouver, WA (US); Michael Lee Hilton, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/049,123

(22) PCT Filed: Jun. 18, 2018

(86) PCT No.: PCT/US2018/038139
§ 371 (c)(1),
(2) Date: Oct. 20, 2020

(87) PCT Pub. No.: WO2019/245526
PCT Pub. Date: Dec. 26, 2019

(65) Prior Publication Data

US 2021/0237445 A1 Aug. 5, 2021

(51) Int. Cl.
*B41J 2/16* (2006.01)
*B41J 2/17* (2006.01)
*B41J 2/14* (2006.01)

(52) U.S. Cl.
CPC ..... *B41J 2/164* (2013.01); *B41J 2/1721* (2013.01); *B41J 2002/14419* (2013.01)

(58) Field of Classification Search
CPC . B41J 2/164; B41J 2/1721; B41J 2002/14419
See application file for complete search history.

(56) References Cited

U.S. PATENT DOCUMENTS

| | | | | |
|---|---|---|---|---|
| 6,637,859 | B2 | 10/2003 | Williamson et al. | |
| 9,033,462 | B2 | 5/2015 | Komaki | |
| 9,227,413 | B2 | 1/2016 | Tsujino et al. | |
| 9,302,489 | B2 | 4/2016 | Sugimoto et al. | |
| 9,481,177 | B2 | 11/2016 | Takano et al. | |
| 2011/0221824 | A1 | 9/2011 | Sakata et al. | |
| 2013/0182050 | A1* | 7/2013 | Aoki | B41J 2/17523 347/86 |
| 2016/0075140 | A1 | 3/2016 | Takano | |
| 2018/0111378 | A1* | 4/2018 | Kudo | B41J 2/17553 |

FOREIGN PATENT DOCUMENTS

| | | | |
|---|---|---|---|
| EP | 0928694 | B1 | 7/2001 |
| JP | 2017226131 | A | 12/2017 |
| WO | WO-2011162109 | A1 | 12/2011 |

* cited by examiner

*Primary Examiner* — Lamson D Nguyen
(74) *Attorney, Agent, or Firm* — Dicke Billig & Czaja PLLC

(57) ABSTRACT

A leak mitigation device includes a planar portion and a tail portion. The planar portion has a first width. The tail portion has a proximal end and a distal end. The proximal end is attached to the planar portion and has a second width less than the first width. The planar portion and the tail portion comprise an absorbent material.

15 Claims, 5 Drawing Sheets

LEAK MITIGATION DEVICES

BACKGROUND

Manifolds may be used to route fluid in two-dimensional (2D) printers, three-dimensional (3D) printers, and other devices. Manifolds may be fabricated by heat staking a film to a rigid plastic part. Heat staking is advantageous for its low cost and the tooling used is relatively simple and cost effective. Disadvantages of heat staking is the fragility of the film and low tolerance to part flatness variations.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

Heat staked manifolds may have latent failures due to the fragility of the film and the low tolerance to part flatness variations. Manifolds may fail in the field even after passing aggressive leak tests. The failures may be large or small. If a failure is substantial, fluid may escape and contaminate a customer's environment. When the manifold is part of a 2D or 3D printer, a leak may damage the output, contaminate portions of the printer, or leak out of the printer.

Accordingly, disclosed herein are leak mitigation devices that may be used with fluid manifolds. The leak mitigation devices may perform two functions including: 1) applying pressure to a leak to slow or stop the leak, and 2) direct leaked fluid to a safe location. A cover over a leak mitigation device may press the leak mitigation device against a fluid manifold. The leak mitigation device may include a planar portion and a tail portion attached to the planar portion. Leaked fluid from a fluid manifold is directed to the end of the tail portion due to gravity such that the leaked fluid forms into droplets and falls from the end of the tail portion. The leak mitigation device may include a transition portion between the planar portion and the tail portion. The transition portion may include a slit to pass therethrough the tail portion to position the tail portion at a lowermost point of the leak mitigation device and to direct leaked fluid into a well.

Figure 1:
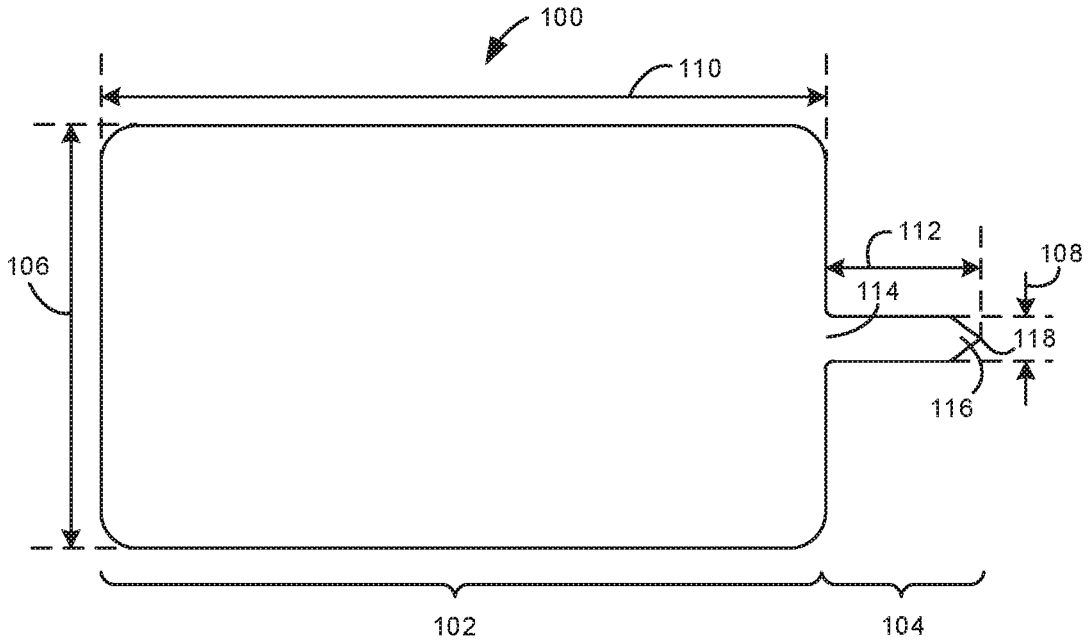
FIG. 1 is a top view of one example of a leak mitigation device.

FIG. 1 is a top view of one example of a leak mitigation device 100. Leak mitigation device 100 may be used with a fluid manifold to slow or stop leaks of the fluid manifold and/or to direct any leaked fluid from a fluid manifold to a safe location. Leak mitigation device 100 includes a planar portion 102 and a tail portion 104. Tail portion 104 may be center aligned with planar portion 102. In one example, planar portion 102 and tail portion 104 are formed from a single piece of material. The planar portion 102 and the tail portion 104 may include an absorbent material. The absorbent material may include felt, cellulose, or another material suitable for absorbing fluid.

Planar portion 102 has a first width indicated at 106 and a first length indicated at 110. The width 106 and length 110 of planar portion 102 may be selected based upon the fluid manifold used. In one example, planar portion 102 may have a width 106 between 40 mm and 70 mm and a length 110 between 80 mm and 110 mm for use with a fluid manifold in an inkjet printer.

Tail portion 104 has a second width indicated at 108 and a second length indicated at 112. The second width 108 is less than the first width 106. The width 108 and length 112 of tail portion 104 may be selected based upon the fluid manifold used. In one example, tail portion 104 may have a width 108 between 4 mm and 10 mm and a length 112 between 10 mm and 40 mm for use with a fluid manifold in an inkjet printer. Tail portion 104 includes a proximal end 114 and a distal end 116. Distal end 116 may be tapered. The proximal end 114 has the second width 108 and is attached to planar portion 102. Tapered proximal end 116 may include a point 118. In other examples, point 118 may be rounded. In any case, point 118 may have the smallest surface area of leak mitigation device 100 to facilitate drop formation as will be described below.

Figure 2:
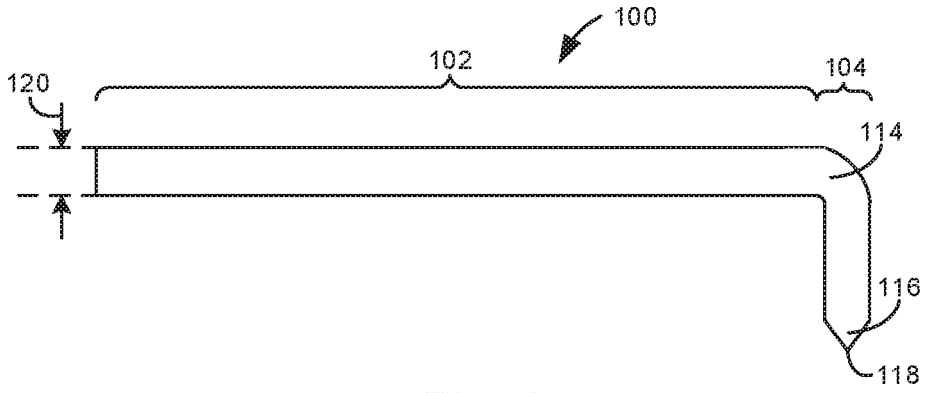
FIG. 2 is a side view of one example of the leak mitigation device of FIG. 1 ready for use.

FIG. 2 is a side view of one example of the leak mitigation device 100 of FIG. 1 ready for use. Leak mitigation device 100 has a thickness indicated at 120. The thickness 120 may be selected based upon the fluid manifold used. In one example, thickness 120 may be between 1 mm and 5 mm for use with a fluid manifold in an inkjet printer. In use, tail portion 104 is bent downward as shown in FIG. 2. Therefore, the tip 118 of distal end 116 of tail portion 104 is the lowermost point of leak mitigation device 100. Accordingly, in the event of a leak, if leak mitigation device 100 becomes saturated, excess fluid is directed due to gravity to the distal end 116 of tail portion 104, where the fluid forms into droplets at point 118. The droplets then fall to a safe location under tail portion 104.

Figure 3:
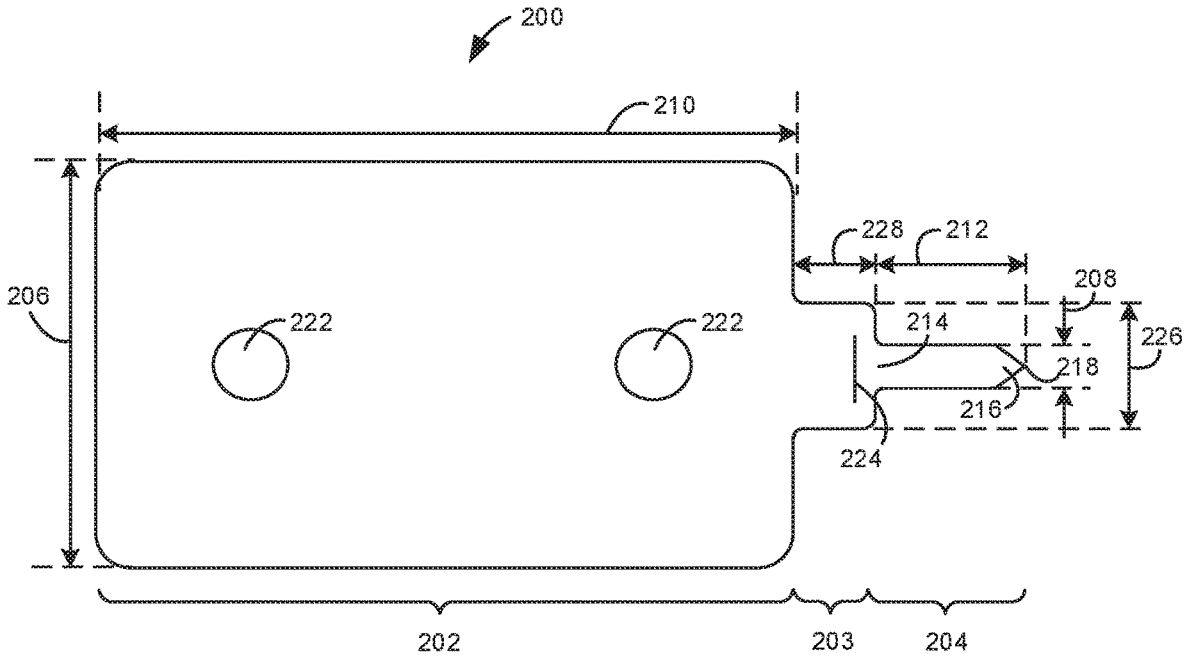
FIG. 3 is a top view of another example of a leak mitigation device.

FIG. 3 is a top view of another example of a leak mitigation device 200. Leak mitigation device 200 may be used with a fluid manifold to slow or stop leaks of the fluid manifold and/or to direct any leaked fluid from a fluid manifold to a safe location. Leak mitigation device 200 includes a planar portion 202, a transition portion 203, and a tail portion 204. Tail portion 204, transition portion 203, and planar portion 202 may be center aligned with each other. In one example, planar portion 202, transition portion 203, and tail portion 204 are formed from a single piece of material. The planar portion 202, the transition portion 203, and the tail portion 204 may include an absorbent material. The absorbent material may include felt, cellulose, or another material suitable for absorbing fluid.

Planar portion 202 has a first width indicated at 206 and a first length indicated at 210. The width 206 and length 210 of planar portion 202 may be selected based upon the fluid manifold used. In one example, planar portion 202 may have a width 206 between 40 mm and 70 mm (e.g., 54 mm) and a length 210 between 80 mm and 110 mm (e.g., 93 mm) for use with a fluid manifold in an inkjet printer.

Tail portion 204 has a second width indicated at 208 and a second length indicated at 212. The second width 208 is less than the first width 206. The width 208 and length 212 of tail portion 204 may be selected based upon the fluid manifold used. In one example, tail portion 204 may have a width 208 between 4 mm and 10 mm (e.g., 6 mm) and a length 212 between 10 mm and 40 mm (e.g., 19 mm) for use with a fluid manifold in an inkjet printer. Tail portion 204 includes a proximal end 214 and a tapered distal end 216. The proximal end 214 has the second width 208 and is attached to planar portion 202 via transition portion 203. Tapered proximal end 216 may include a point 218. In other examples, point 218 may be rounded. In any case, point 218 may have the smallest surface area of leak mitigation device 200 to facilitate drop formation as will be described below.

Transition portion 203 is between planar portion 202 and tail portion 204. Transition portion 203 has a third width indicated at 226 and a third length indicated at 228. Third width 226 is less than first width 206 of planar portion 202 and greater than second width 208 of tail portion 204. In one example, transition portion 203 may have a width 226 between 10 mm and 20 mm (e.g., 16 mm) and a length 228 between 5 mm and 15 mm (e.g., 11 mm) for use with a fluid manifold in an inkjet printer.

Transition portion 203 may include a slit 224 extending through leak mitigation device 200. Slit 224 may be arranged perpendicular to the length of tail portion 204. Slit 224 may be between 4 mm and 14 mm (e.g., 8 mm) long. In any case, slit 224 may be long enough to pass therethrough the distal end 216 of tail portion 204 as will be described in more detail below. Slit 224 may be arranged closer to tail portion 204 than to planar portion 202. In one example, slit 224 may be arranged between 1 mm and 5 mm (e.g., 3 mm) from proximal end 214 of tail portion 204.

Leak mitigation device 200 may include through-holes 222. Each through-hole 222 may be arranged at any suitable location of leak mitigation device 200. Each through-hole 222 may be round in shape. In other examples, through-holes 222 may have another suitable shape (e.g., rectangular). Each through-hole 222 may be used to position leak mitigation device 200 and/or to provide access to the fluid manifold used. In other examples, through-holes 222 may be excluded or leak mitigation device 200 may include one (i.e., a single) through-hole 222 or more than two through-holes 222.

Figure 4:
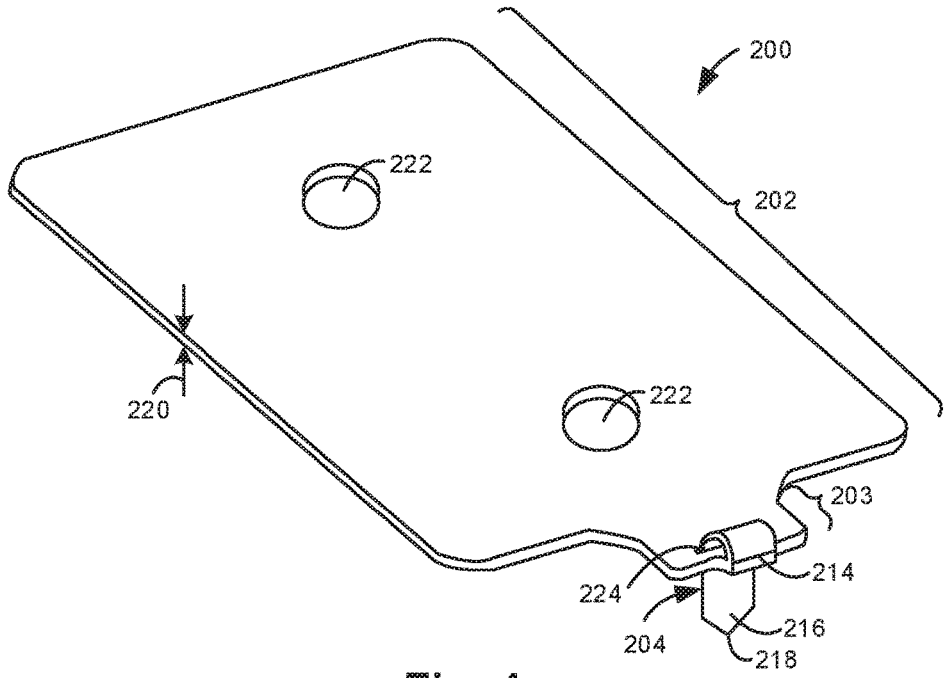
FIG. 4 is a perspective view of the leak mitigation device of FIG. 3 ready for use.

FIG. 4 is a perspective view of the leak mitigation device 200 of FIG. 3 ready for use. Leak mitigation device 200 has a thickness indicated at 220. The thickness 220 may be selected based upon the fluid manifold used. In one example, thickness 220 may be between 1 mm and 5 mm (e.g., 1 mm) for use with a fluid manifold in an inkjet printer. In use, tail portion 204 is passed through slit 224 to position the distal end 216 of tail portion 204 at the lowermost point of leak mitigation device 200 as shown in FIG. 4. Therefore, the tip 218 of distal end 216 of tail portion 204 is the lowermost point of leak mitigation device 200. Accordingly, in the event of a leak, if leak mitigation device 200 becomes saturated, excess fluid is directed due to gravity to the distal end 216 of tail portion 204, where the fluid forms into droplets at point 218. The droplets then fall to a safe location under tail portion 204.

Figure 5:
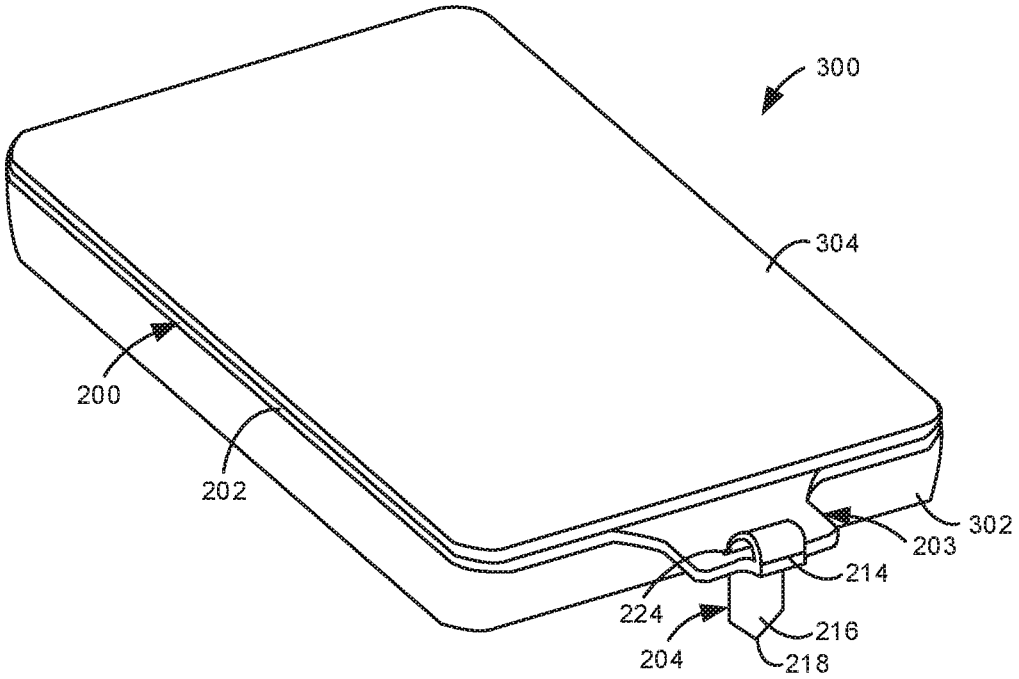
FIG. 5 is a perspective view of one example of an assembly including the leak mitigation device of FIG. 4.

FIG. 5 is a perspective view of one example of an assembly 300 including the leak mitigation device 200 of FIG. 4. In addition to leak mitigation device 200, assembly 300 may also include a fluid manifold 302 and a cover 304. Cover 304 presses leak mitigation device 200 against fluid manifold 302. The planar portion 202 of leak mitigation device 200 is arranged between fluid manifold 302 and cover 304. The tail portion 204 of leak mitigation device 200 is attached to the planar portion 202 and transverse to the fluid manifold 302. The transition portion 203 between the planar portion 202 and the tail portion 204 includes the slit 224 to pass therethrough the tail portion 204 to position the tail portion transverse to fluid manifold 302.

Figure 6:
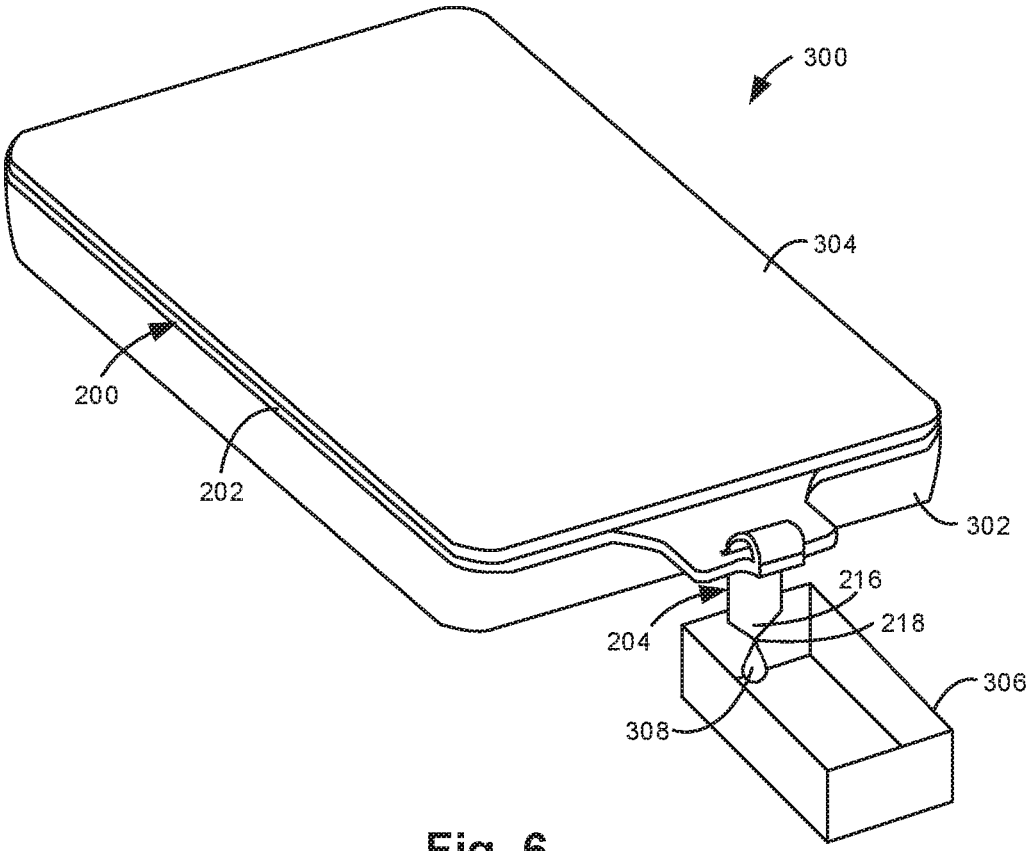
FIG. 6 is a perspective view of one example of the assembly of FIG. 5 in use.

FIG. 6 is a perspective view of one example of the assembly of FIG. 5 in use. With assembly 300 installed in a system, a well 306 is arranged under tail portion 204. Well 306 provides a safe location for collecting leaked fluid from fluid manifold 302, thereby preventing leaked fluid from escaping. Leak mitigation device 200 may include an absorbent material to slow or stop the flow of leaking fluid from fluid manifold 302. Leak mitigation device 200 may include an absorbent material to direct leaked fluid from fluid manifold 302 to an end (i.e., point 218) of tail portion 204 due to gravity such that the leaked fluid forms into droplets 308 and falls from the end of the tail portion into well 306. The fluid collected within well 306 may evaporate and/or be removed by a user.

Figure 7:
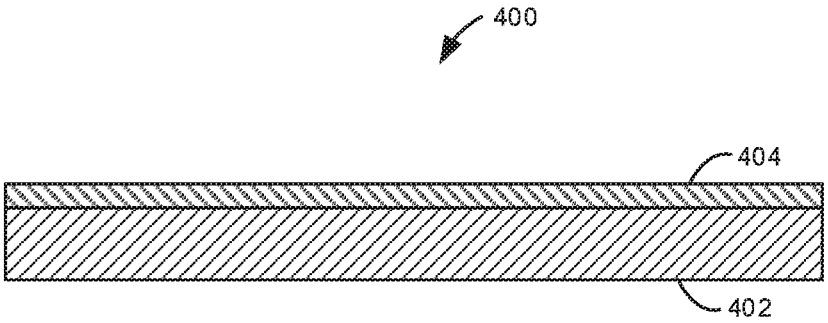
FIG. 7 is a cross-sectional view of one example of a fluid manifold.

FIG. 7 is a cross-sectional view of one example of a fluid manifold 400. Fluid manifold 400 may be used for fluid manifold 302 previously described and illustrated with reference to FIGS. 5 and 6. In one example, fluid manifold 400 includes a rigid part 402 and a film 404 heat staked to the rigid part 402. Rigid part 402 may include a plurality of channels for routing fluid to other parts of a system, such as for routing ink to a printhead of a printer. In use, a leak mitigation device, such as leak mitigation device 100 of FIG. 2 or leak mitigation device 200 of FIG. 4, may be pressed against the film 404 to slow or stop leaks from fluid manifold 400 and/or to direct leaked fluid from fluid manifold 400 to a safe location.

Figure 8A:
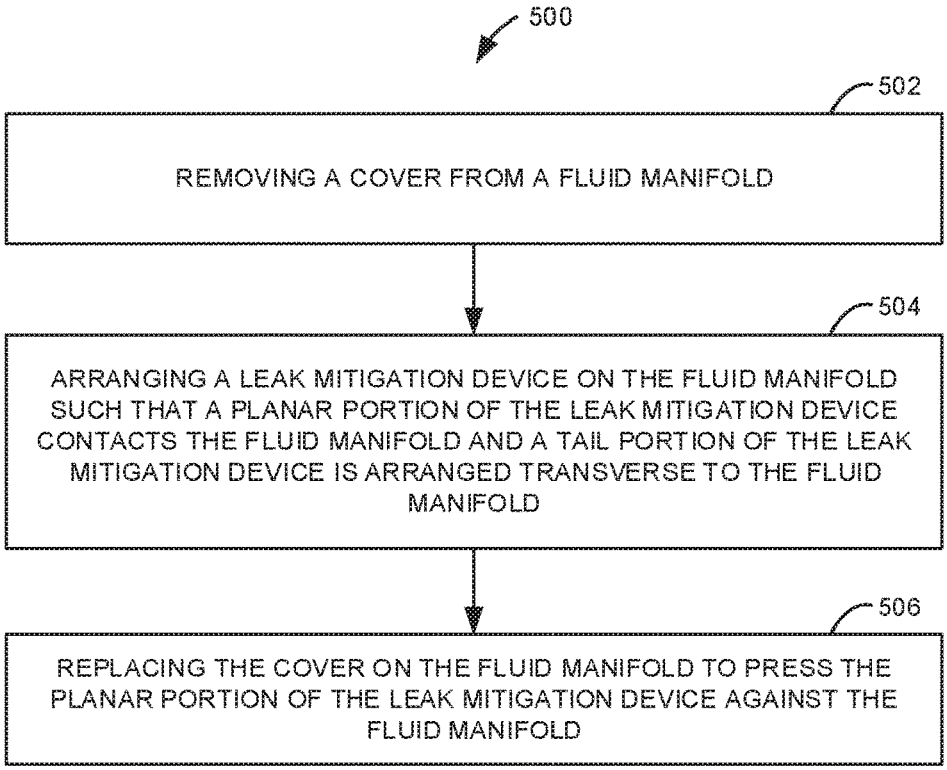
FIGS. 8A-8B are flow diagrams illustrating one example of a method for retrofitting a fluid handling device.
Figure 8B:
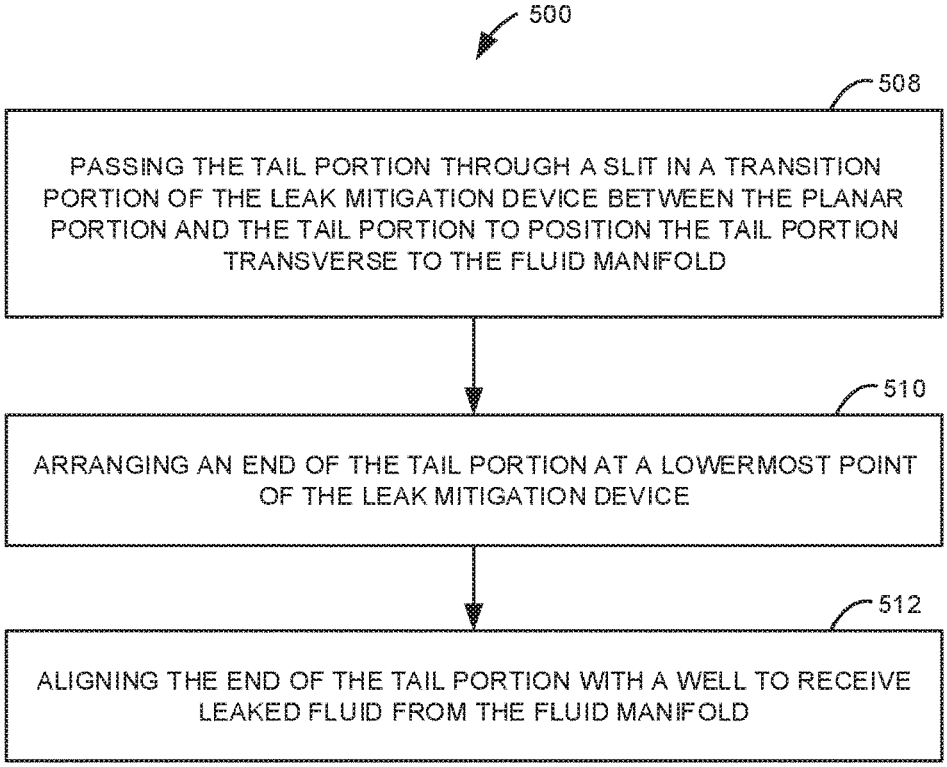

FIGS. 8A-8B are flow diagrams illustrating one example of a method 500 for retrofitting a fluid handling device, such as a fluid handling device in a 2D or 3D printer. As illustrated in FIG. 8A, at 502 method 500 includes removing a cover from a fluid manifold. At 504, method 500 includes arranging a leak mitigation device on the fluid manifold such that a planar portion of the leak mitigation device contacts the fluid manifold and a tail portion of the leak mitigation device is arranged transverse to the fluid manifold. At 506, method 500 includes replacing the cover on the fluid manifold to press the planar portion of the leak mitigation device against the fluid manifold.

As illustrated in FIG. 8B, at 508 method 500 may also include passing the tail portion through a slit in a transition portion of the leak mitigation device between the planar portion and the tail portion to position the tail portion transverse to the fluid manifold. At 510, method 500 may also include arranging an end of the tail portion at a lowermost point of the leak mitigation device. At 512, method 500 may also include aligning an end of the tail portion with a well to receive leaked fluid from the fluid manifold.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A leak mitigation device comprising:

a planar portion having a first width; and a tail portion having a proximal end and a distal end, the proximal end attached to the planar portion and having a second width less than the first width;

wherein the planar portion and the tail portion comprise an absorbent material.

2. The leak mitigation device of claim 1, further comprising:

a transition portion between the planar portion and the tail portion, the transition portion having a third width less than the first width and greater than the second width.

3. The leak mitigation device of claim 2, wherein the transition portion comprises a slit to pass therethrough the distal end of the tail portion to position the distal end of the tail portion at a lowermost point of the leak mitigation device.

4. The leak mitigation device of claim 3, wherein the planar portion is to absorb fluid and direct the fluid to the distal end of the tail portion due to gravity such that the fluid forms into droplets and falls from the distal end.

5. The leak mitigation device of claim 1, wherein the absorbent material comprises felt or cellulose.

6. The leak mitigation device of claim 1, wherein the distal end of the tail portion is tapered.

7. An assembly comprising:

a fluid manifold;

a leak mitigation device; and a cover pressing the leak mitigation device against the fluid manifold, wherein the leak mitigation device comprises a planar portion arranged between the fluid manifold and the cover and a tail portion attached to the planar portion and transverse to the fluid manifold.

8. The assembly of claim 7, wherein the leak mitigation device comprises a transition portion between the planar portion and the tail portion, the transition portion comprising a slit to pass therethrough the tail portion to position the tail portion transverse to the fluid manifold.

9. The assembly of claim 7, wherein the leak mitigation device comprises an absorbent material to direct leaked fluid from the fluid manifold to an end of the tail portion due to gravity such that the leaked fluid forms into droplets and falls from the end of the tail portion.

10. The assembly of claim 7, wherein the leak mitigation device comprises an absorbent material to slow or stop the flow of leaking fluid from the fluid manifold.

11. The assembly of claim 7, wherein the fluid manifold comprises a rigid part and a film heat staked to the rigid part, and wherein the cover presses the leak mitigation device against the film.

12. A method for retrofitting a fluid handling device, the method comprising:

removing a cover from a fluid manifold;

arranging a leak mitigation device on the fluid manifold such that a planar portion of the leak mitigation device contacts the fluid manifold and a tail portion of the leak mitigation device is arranged transverse to the fluid manifold; and replacing the cover on the fluid manifold to press the planar portion of the leak mitigation device against the fluid manifold.

13. The method of claim 12, further comprising:

passing the tail portion through a slit in a transition portion of the leak mitigation device between the planar portion and the tail portion to position the tail portion transverse to the fluid manifold.

14. The method of claim 12, further comprising:

arranging an end of the tail portion at a lowermost point of the leak mitigation device.

15. The method of claim 12, further comprising:

aligning an end of the tail portion with a well to receive leaked fluid from the fluid manifold.

* * * * *